US010045673B2

(12) United States Patent
Foenss

(10) Patent No.: US 10,045,673 B2
(45) Date of Patent: Aug. 14, 2018

(54) VACUUM CLEANER WITH HINGED FLAP

(71) Applicant: Nilfisk-Advance A/S, Brøndby (DK)

(72) Inventor: Anders Foenss, Gistrup (DK)

(73) Assignee: NILFISK-ADVANCE A/S, Brondby (DK)

( * ) Notice: Subject to any disclaimer, the term of this patent is extended or adjusted under 35 U.S.C. 154(b) by 405 days.

(21) Appl. No.: 14/541,191

(22) Filed: Nov. 14, 2014

(65) Prior Publication Data

US 2015/0135475 A1 May 21, 2015

(30) Foreign Application Priority Data

Nov. 15, 2013 (DE) ..... 10 2013 019 224

(51) Int. Cl.

| | |
|---|---|
| ***A47L 9/14*** | (2006.01) |
| ***A47L 5/36*** | (2006.01) |
| ***A47L 9/20*** | (2006.01) |
| ***A47L 9/00*** | (2006.01) |

(52) U.S. Cl.

CPC ..... *A47L 9/1409* (2013.01); *A47L 5/36* (2013.01); *A47L 5/362* (2013.01); *A47L 9/00* (2013.01); *A47L 9/1463* (2013.01); *A47L 9/20* (2013.01)

(58) Field of Classification Search

CPC ..... A47L 9/009; A47L 9/1683; A47L 5/362; A47L 9/00; A47L 9/1409; A47L 9/20; A47L 9/1463; A47L 5/36

See application file for complete search history.

(56) References Cited

U.S. PATENT DOCUMENTS

| | | | | |
|---|---|---|---|---|
| 2,409,078 | A * | 10/1946 | Swann | A47L 5/362 55/472 |
| 3,300,806 | A * | 1/1967 | Ripple | A47L 5/32 15/334 |
| 4,007,026 | A | 2/1977 | Groh | |
| 4,328,014 | A | 5/1982 | Burgoon et al. | |
| 4,580,313 | A * | 4/1986 | Blehert | A47L 11/24 15/349 |
| 5,400,464 | A * | 3/1995 | Steiner | A47L 9/0072 15/330 |
| 7,644,471 | B2 | 1/2010 | Bott et al. | |
| 8,745,817 | B2 | 6/2014 | Stein et al. | |
| 2003/0167590 | A1 * | 9/2003 | Oh | A47L 9/104 15/347 |

(Continued)

FOREIGN PATENT DOCUMENTS

| | | | |
|---|---|---|---|
| CN | 1728961 | A | 2/2006 |
| CN | 201150509 | Y | 11/2008 |

(Continued)

OTHER PUBLICATIONS www.powervac.biz, Floortec 560—Battery Powered Walk Behind Sweeper, NilFloortec 560B.

(Continued)

*Primary Examiner* — Robert Scruggs

(74) *Attorney, Agent, or Firm* — Browdy and Neimark, PLLC

(57) ABSTRACT

A vacuum cleaner having a housing that consists of a bottom part with a dirt receptacle and a top part. At least one filter is arranged in the housing and an intake airflow can flow through it, and the housing has at least one hinged housing in which the at least one filter is arranged.

8 Claims, 4 Drawing Sheets

(56) References Cited

U.S. PATENT DOCUMENTS

| | | | | |
|---|---|---|---|---|
| 2004/0237246 | A1* | 12/2004 | Nam | A47L 5/14 15/334 |
| 2009/0000485 | A1 | 1/2009 | Valentini | |
| 2009/0133212 | A1 | 5/2009 | Morishita | |
| 2009/0193612 | A1* | 8/2009 | Weiss | A47L 9/0081 15/347 |
| 2013/0031731 | A1* | 2/2013 | Hess | A47L 9/00 15/3 |

FOREIGN PATENT DOCUMENTS

| | | |
|---|---|---|
| DE | 4138223 | 2/1993 |
| DE | 19821705 | 11/1999 |
| DE | 10101219 | 7/2002 |
| DE | 20318350 | 3/2004 |
| DE | 102010026441 | 9/2011 |
| EP | 1340446 | 9/2003 |
| EP | 1997415 | 9/2010 |

OTHER PUBLICATIONS www.nilfisk-advance.com, Nilfisk SW 7005/8505, High Standard Walk-Behind Sweepers, 2003.

* cited by examiner

VACUUM CLEANER WITH HINGED FLAP

FIELD

The invention relates to a vacuum cleaner with a hinged flap.

BACKGROUND

With a floor cleaning device by Nilfisk ALTO of the type Floortec 560B or the type SW700, a removable flap is arranged on the backside of the housing behind which an angled folded filter is arranged against which a stream of dedusting air flows. The advantage of the arrangement of an angled folded filter is that the flow of dedusting air impinges at an angle on the folded filter and, as the folded filter becomes increasingly clogged, the closest part of the folded filter extending into the vacuum cleaner receptacle clogs completely, and the top part of the folded bag that is furthest from the vacuum cleaner receptacle clogs slowest.

This improves the service life of the folded filter arranged at an angle above the vacuum cleaner receptacle.

The arrangement of such a folded filter arranged at an angle relative to the floor area of the vacuum cleaner receptacle has proven itself. A disadvantage of the arrangement is however that, to exchange the folded filter or an equivalent fleece, it is difficult to access because the operator must kneel on the floor in order to remove the folder filter from the housing of the vacuum cleaner.

The cleaning device for the filter may also have to be removed beforehand, which is associated with a great deal of effort.

SUMMARY

The objective of the invention is therefore to develop a vacuum cleaner with angled filters of the generic kind such that the filter is easily exchangeable without a great deal of effort, and different dedusting devices can be easily used.

The invention is characterized by the technical teaching of the claims to achieve the addressed objective.

An essential feature of the invention is that the angled filter, which is preferably designed as a flat filter, is accommodated in an angled parting plane of a hinged housing. The hinged housing is substantially arranged on a horizontal axis on the top part of the vacuum cleaner such that, when the housing is swung, the one or more flat filters are simultaneously accessible without having to perform exchanging tasks on the housing of the vacuum cleaner.

The value of the invention is hence that the filter is no longer accommodated in a frame with a fixed housing but rather in a hinged flap. The hinged flap is preferably arranged on a horizontal axis on the top side or bottom side of the vacuum cleaner that forms an angled parting plane in which the one or more flat filters are arranged.

By simply swinging up or swinging down the hinged housing, the flat filters arranged on the inside of the hinged housing in the area of the parting wall are accessible and can easily be changed.

An additional advantage of the invention is that it is now possible to arrange associated dedusting devices in the interior of the hinged flap which has not been possible to date in the prior art.

Such a dedusting device can for example be designed as a 3-way valve like the subject of DE 101 01 219 B4.

Another dedusting device has been for example disclosed by the subject matter of DE 41 38 223 C1 which can be installed in the same manner within the interior of the hinged housing according to the invention.

The use of electrically switchable 3-way valves is for example disclosed by the subject matter of EP 1 997 415 B1. Such an arrangement can also be easily installed within the interior of the hinged housing.

This yields the advantage that, when opening the hinged housing, the dedusting devices associated with the flat filters are also easily accessible, and not just the one or more flat filters arranged in the hinged housing. This was unknown beforehand in the prior art.

The term "flat filter" used here is not to be interpreted restrictively. Instead of a flat filter, any type of filter can be used such as a filter fleece, round filter, zigzag filter, folded filter of any type, or the like. It is only essential that, in the parting surface of the hinged housing, an air-conducting connection is created between the air channels of the vacuum cleaner itself and the inner chamber of the hinged housing such that the flat filters are arranged in the parting surface of the hinged housing, and the the dedusting flows pass through the interior of the hinged housing.

An airflow entering the hinged housing accordingly passes through, as well as an airflow exiting therefrom, as will be described later with reference to the drawings.

In another advantageous embodiment, the hinged housing is designed in at least two parts. The two hinged housing parts can then each be opened and closed using hinges in the side area of the vacuum cleaner housing. For example, each hinged housing part can have a flat filter, thus rendering the filter easily accessible. The arrangement of one flat filter in one hinged housing part would also be possible, while the other hinged housing part has the intake opening for the intake channel.

The subject matter of the present invention not only results from the subject matter of the individual patent claims, but also from the combination of the individual patent claims with each other.

All of the information and features disclosed in the documents including the abstract, in particular the spatial layout depicted in the drawings, are claimed as essential to the invention to the extent that they are novel over the prior art individually or in combination.

BRIEF DESCRIPTION OF THE DRAWINGS

The invention is explained below in greater detail with reference to drawings that merely depict one embodiment. Additional features essential to the invention and advantages of the invention are offered in the drawings and their description.

In the figures.

DETAILED DESCRIPTION

Figure 1:
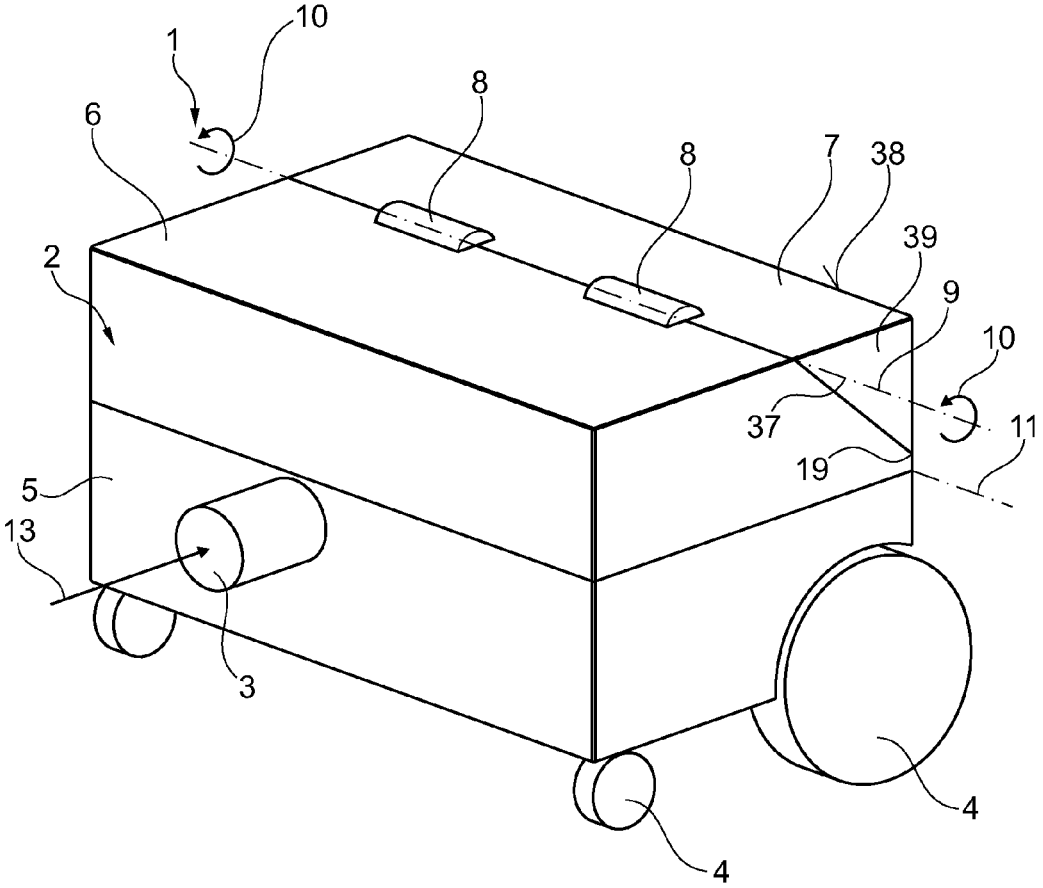
FIG. 1: Shows a perspective of a first embodiment of a vacuum cleaner with a hinged housing.

FIG. 1 shows a generic vacuum cleaner 1 with a housing 2 in any desired shape that substantially consists of a bottom part 5 and a top part 6. The two parts 5, 6 can be designed separable from each other, wherein the dirt receptacle 12 is arranged in the bottom part 5 and, in an airtight manner, receives air laden with dirt in the direction of the arrow 13 through an inlet port 3.

Preferably the motor 22 and the turbine 23 driven thereby are arranged in the top part 6 of the housing 2. The housing 2 is supported on the ground by rollers 4.

According to FIG. 1, the invention consists of at least one side surface or one housing edge in the top part 6 being designed as a hinged housing 7, wherein the hinged housing 7 is opened and closed in the direction of the arrow 10 by top hinges 8 in a horizontal pivot axis 9.

In an alternative embodiment, a bottom pivot axis 11 can be provided instead of the top pivot axis 9 such that the hinged housing 7 is not swung from bottom to top but rather conversely from top to bottom.

The drawing does not show that a side pivot axis could also be provided which is configured in the area to be aligned approximately equivalent to the parting surface 37 such that the overall hinged housing 7 is designed to be pivotable on a side surface.

It is hence only important for the hinged housing 7 to be pivotably arranged on the top part 6 of the housing 2 of the vacuum cleaner 1 in at least one pivot axis 9, 11, and for the one or more flat filters 16, 26 according to the invention to be arranged in the area of the hinged housing 7.

Figure 2:
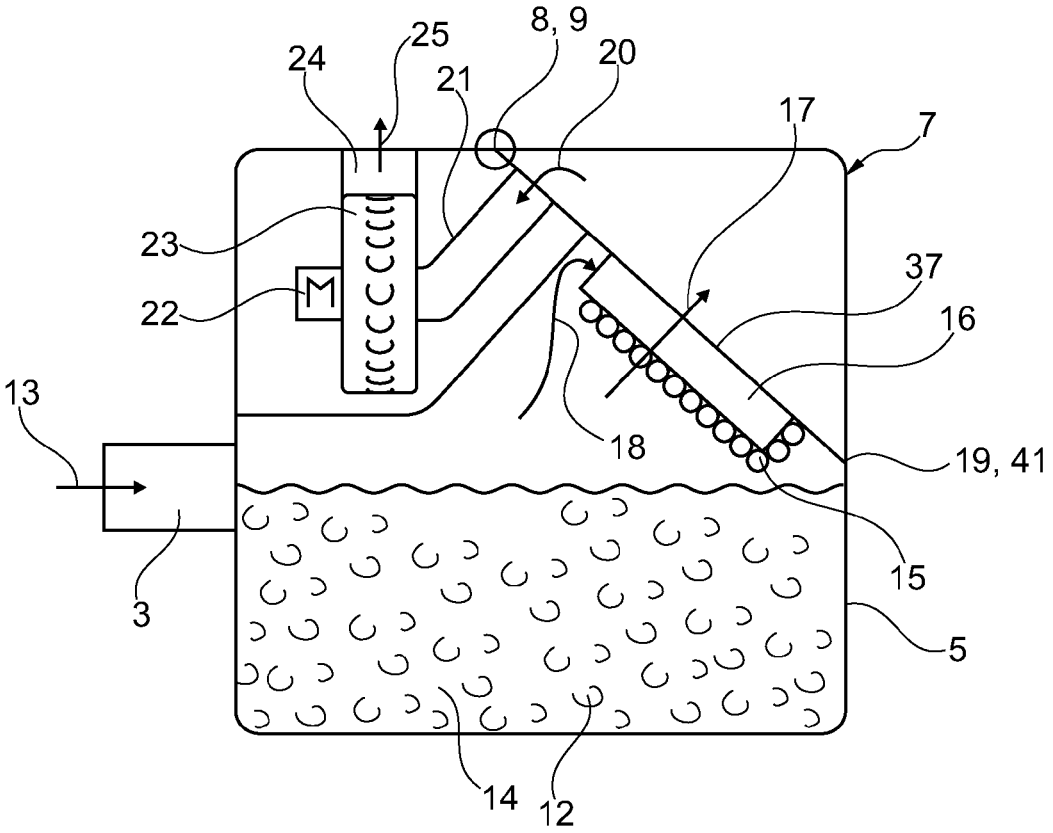
FIG. 2: Shows a schematic section of a vacuum cleaner according to FIG. 1.

As a first embodiment, FIG. 2 shows that dirt 14 collects in the interior of the dirt receptacle 12 and settles as a deposit 15 on the side surfaces of the flat filter 16 as the fill level of the dirt receptacle 12 increases.

As the fill level of the dirt 14 in the dirt receptacle 12 increases, the deposits 15 on the side of the intake surface of the flat filter 16 rise, and it is important that a flow of air 18 can still impinge upon the top area of the flat filter. The top area can therefore be used for a long time even though the deposits 15 have collected in the middle from the dedusting flow passing through the flat filter in the direction of the arrow 17.

The flat filter 16 installed at an angle in the direction toward the dirt receptacle 12 possesses the additional advantage in that the adhesive effect of the deposits 15 is not as strong on the folds of the flat filter 16, which also generates a certain dedusting effect.

The dedusting airflow (arrow direction 17) penetrating the interior of the flat filter 16 is diverted in the interior of the hinged housing 7 and is then introduced into the intake channel 21 arranged therein in the direction of the arrow 20.

This presumes that the parting plane 37 (that is, the angled housing edge of the hinged housing 7) is connected airtight to the associated plane within the vacuum cleaner housing. The mouth of the intake channel 21 is also connected airtight to an associated penetration in the parting plane at 37 of the hinged housing.

The airflow is introduced in the direction of the arrow 20 into the intake channel 21, wherein the airflow is generated by a turbine 23 which is driven by a motor 22. The airflow then leaves the exhaust channel 24 in the direction of the arrow 25.

It is accordingly important for a parting plane 19 to be arranged between the one angled parting surface 37 of the hinged housing 7 and the associated surface within the housing 2 of the vacuum cleaner 1.

Accordingly, for the first time, it is possible to easily access the entire flat filter 16 with all of the installed components from the outside by swinging up the hinged housing 7 on the hinges 8 (FIG. 2) and the hinge axis 9.

Figure 3:
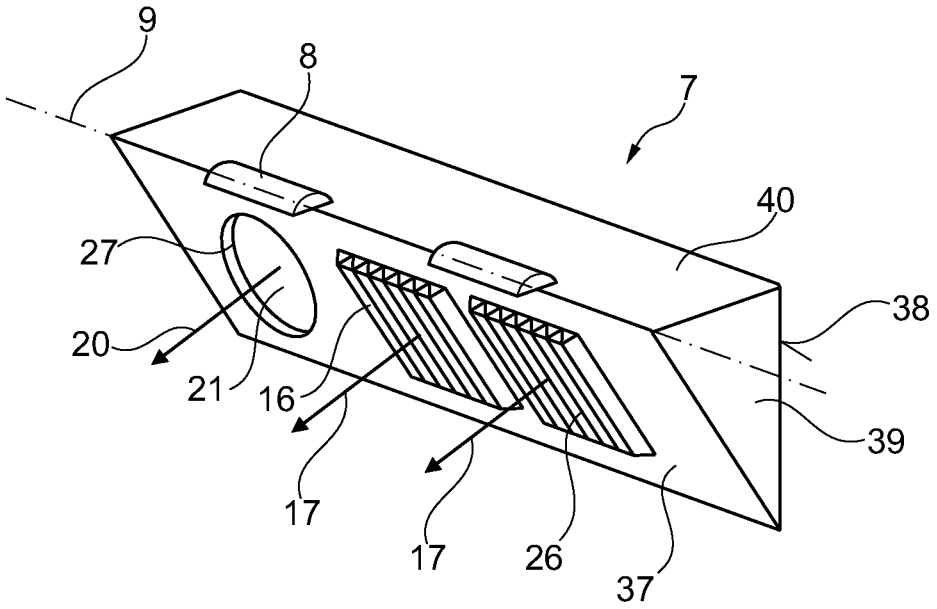
FIG. 3: Shows a perspective view of a first embodiment of a hinged housing.

FIG. 3 shows an embodiment modified from FIG. 2 in which, instead of one flat filter 16, two parallel flat filters 16, 26 are arranged in the vacuum cleaner receptacle that are impinged upon by the airflow in the direction of the arrow 17 due to the vacuum in the vacuum cleaner receptacle. Otherwise, the same designations apply to the same parts.

In comparison to FIG. 2, FIG. 3 shows that the interior of the hinged housing 7 is sealed from the atmosphere such that an airtight seal results in the parting plane 19 in the direction toward the housing 2 of the vacuum cleaner 1, and only an air-conducting exhaust opening 27 sealingly connects the intake channel 21 of the housing 2 to the interior of the hinged housing 7.

Figure 4:
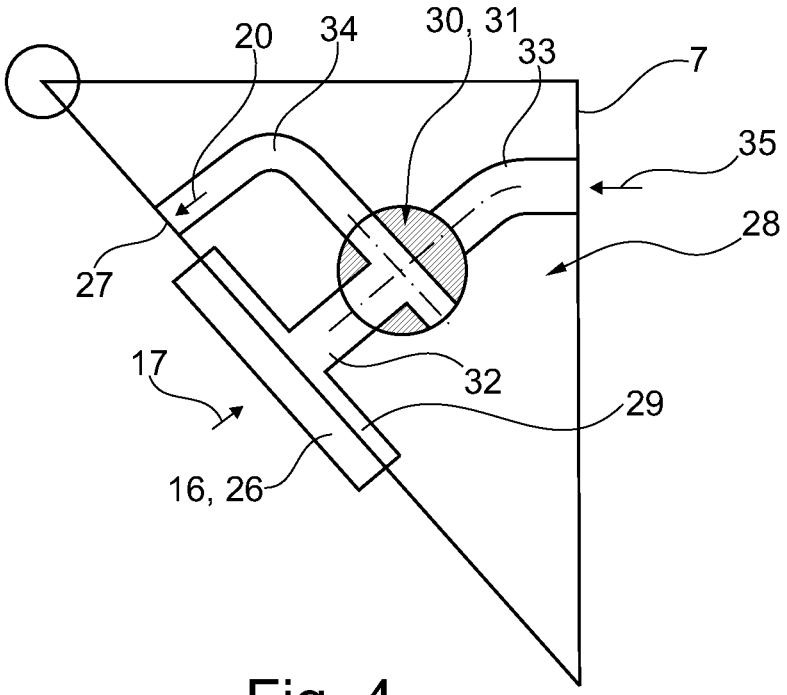
FIG. 4: Shows as a sectional view of a second embodiment of a hinged housing having a dedusting device arranged therein.

As another embodiment, FIG. 4 shows that a dedusting device of any kind can also be arranged in the interior of the hinged housing 7.

As an example, a dedusting device 28 is portrayed in FIG. 4 that basically consists of a 3-way valve 30. The valve cock 31 can be rotated in different directions of rotation.

The drawn position shows the normal position of the flat filter 16, 26, wherein the intake airflow flows through both flat filters 16, 26 and then, via the intake opening 27, reaches the intake channel 21 in the direction of the arrow 20.

If however the valve cock 31 of the 3-way valve 30 is rotated 90°, an airtight connection between channel piece 32 and channel piece 33 arises, and channel piece 34 is closed.

In this manner, surrounding air is drawn in the direction of the arrow of 35 through the channel piece 33 connected to the surrounding air, and is supplied to the folded filters 26 arranged on the backside of one or more flat filters 16, and then the air flows against the folded filters 16, 26 from the rear opposite the direction of the arrow 17 and releases the dirt particles.

Figure 5:
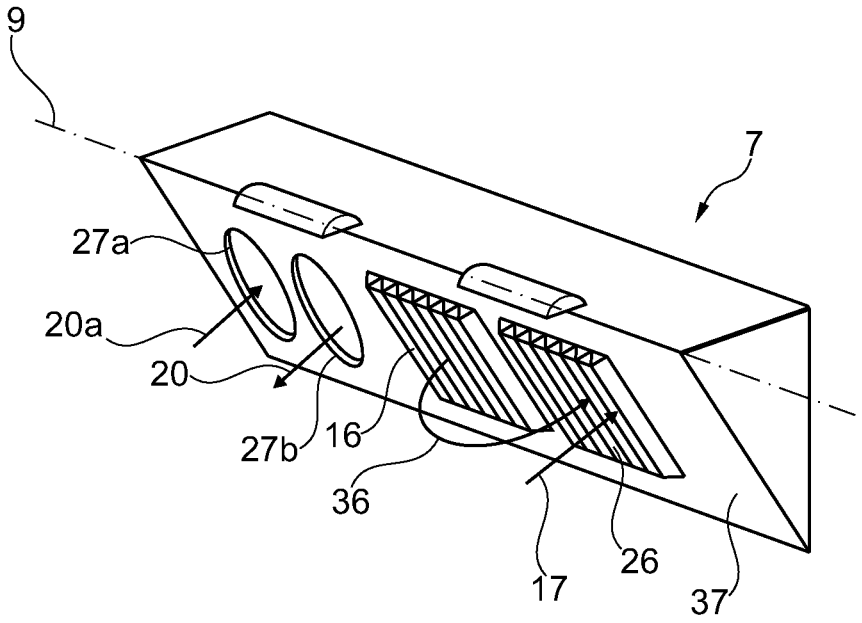
FIG. 5: Shows a third embodiment of a hinged housing with a filter dedusting unit according to DE 101 01 219 B4.

FIG. 5 shows another dedusting device like the subject matter of DE 101 01 219 B4.

In the depicted exemplary embodiment, two flat filters 16, 26 can be dedusted separate from each other, and while the one flat filter 16 is cleaned, the other flat filter 26 remains in operation. In normal position, both flat filters 16, 26, however, serve to remove the dirt from an airflow 17.

In the portrayed exemplary embodiment, the flat filter 16 is cleaned, and its dedusting airflow is conducted as a dedusting airflow 36 to the other flat filter 26, wherein the two intake openings 27*a*, 27*b* are connected in an air-conducting manner to the turbine 23 corresponding to the dedusting position of the dedusting device (not shown).

In the invention, it is important that the hinged housing is a completely closed, airtight housing that has an angled parting surface 37 on the inside, and furthermore has two side surfaces 39 arranged parallel to each other which connect with an anterior front surface 38 at a right angle, and also connect with a top cover surface 40 at a right angle.

The cited surfaces 38, 39, 40 can be designed profiled, bent or curved in any manner. The entire hinged housing can also be designed semicircular, oval or cornered.

LEGEND TO THE DRAWING

1 Vacuum cleaner
2 Housing
3 Inlet port
4 Roller
5 Bottom part
6 Top part
7 Hinged housing
8 Hinge
9 Hinge axis

10 Direction of arrow
11 Hinge axis (alternative)
12 Dirt receptacle
13 Direction of arrow
14 Dirt
15 Deposit
16 Flat filter
17 Direction of arrow
18 Direction of arrow
19 Parting plane
20 Direction of arrow
21 Intake channel
22 Motor
23 Turbine
24 Exhaust channel
25 Direction of arrow
26 Folded filter
27 Intake opening 27*a, b*
28 Dedusting device
29 Air channel
30 3-way valve
31 Valve cock
32 Channel piece
33 Channel piece
34 Channel piece
35 Direction of arrow
36 Dedusting airflow
37 Parting surface (of 7)
38 Front surface
39 Side surface
40 Cover surface

The invention claimed is:

1. A vacuum cleaner (1) comprising:

a housing (2) that consists of a bottom part (5) with a dirt receptacle (12) and a top part (6), the top part (6) comprising a cover part connected to the bottom part (5) and a flap (7) hingedly connected to the cover part, at least one filter (16, 26) through which an intake airflow can flow, and a dedusting device (28) disposed in the flap (7) comprising a 3-way valve (30) to selectively connect the at least one filter (16, 26) to an ambient air intake port and to air intake opening (27) disposed in the flap (7), wherein the at least one filter (16, 26) is disposed in the flap (7), such that when the flap (7) is opened, the at least one filter (16, 26) moves with the flap (7).

2. The vacuum cleaner (1) according to claim 1, further comprising a top hinge (8) to open and close the flap (7) along a horizontal pivot axis (9).

3. The vacuum cleaner (1) according to claim 1, further comprising a bottom hinge (41) to open and close the flap (7) along a horizontal pivot axis (11).

4. The vacuum cleaner (1) according to claim 1, wherein a side pivot axis is connected to the flap (7) such that the flap (7) is pivotable on a side surface (39).

5. The vacuum cleaner (1) according to claim 1, further comprising a turbine (23) having an intake channel (21) which is connected airtight to an associated intake opening (27, 27*a*, 27*b*) of the flap (7).

6. The vacuum cleaner (1) according to claim 1, wherein the flap (7) has a housing edge that serves as a parting plane (37) which is connected airtight to an associated plane in the housing (2).

7. The vacuum cleaner (1) according to claim 1, wherein the dedusting device comprises a first channel (32) connecting the at least one filter to the 3-way valve (30) channels, a second channel (33) connecting the ambient air intake port to the 3-way valve (30), and a third channel (34) connecting the 3-way valve (30) to the air intake opening (27), the 3-way valve (30) comprising a valve cock disposed so as to selectively connect the first, second, and third channels to one another.

8. The vacuum cleaner (1) according to claim 1, wherein the intake airflow can be diverted within the interior of the flap (7).

* * * * *